United States Patent [19]

Shohet

[11] Patent Number: 4,705,222

[45] Date of Patent: Nov. 10, 1987

[54] MULTIPURPOSE MIXER

[75] Inventor: Albert J. Shohet, Forest Park, Ohio

[73] Assignee: Processall, Inc., Cincinatti, Ohio

[21] Appl. No.: 730,190

[22] Filed: May 3, 1985

[51] Int. Cl.[4] ..... B02C 23/08

[52] U.S. Cl. ..... 241/69; 241/101 B; 241/180; 241/181

[58] Field of Search ..... 241/98, 101 R, 101 B, 241/180, 181, 49, 57, 58, 70, 74, 65, 69; 366/92, 209

[56] References Cited

U.S. PATENT DOCUMENTS

| | | | |
|---|---|---|---|
| 2,578,822 | 12/1951 | Miner, Jr. et al. . | |
| 2,750,163 | 6/1956 | Loedige et al. . | |
| 2,807,424 | 9/1957 | Records . | |
| 3,027,102 | 3/1962 | Lödige et al. . | |
| 3,162,428 | 12/1964 | Lödige et al. . | |
| 3,362,356 | 1/1968 | Schröder . | |
| 3,403,640 | 10/1968 | Schröder . | |
| 4,050,897 | 9/1977 | Klein | 241/65 X |
| 4,431,597 | 2/1984 | Cramer et al. | 261/93 |
| 4,582,268 | 4/1986 | Adelmann | 241/171 X |

OTHER PUBLICATIONS

Little Ford Document.
Topo Granulator by Collette.

*Primary Examiner*—Timothy V. Eley
*Attorney, Agent, or Firm*—Antonelli, Terry & Wands

[57] ABSTRACT

A multipurpose mixer useful for performing horizontal and vertical mixing operations with a single apparatus. Mixing element assemblies are replaceable by removal of a first end of a drum. The mixing operations are performed by rotation of an axially disposed drive shaft located within the drum which accepts the removable mixing element assemblies when the first end is removed. The drum is rotatable through a plurality of angular positions around an axis of rotation orthogonal to the driver shaft. The drum is lockable in any one of a plurality of angular orientations including horizontal and vertical orientations of the drive shaft.

27 Claims, 15 Drawing Figures

MULTIPURPOSE MIXER

BACKGROUND OF THE INVENTION

1. Field of the Invention

The present invention relates to apparatus for performing horizontal mixing, liquid mixing and vortex mixing. More particularly, the present invention relates to a single mixer for performing the above-described separate mixing operations and other processing operations.

2. Description of the Prior Art

Horizontal mixers for mixing of solids, semisolids, and pastes are well known. Examples of horizontal mixers are disclosed in U.S. Pat. Nos. 2,750,163, 3,027,102 and 3,162,428. Horizontal mixers typically contain a plurality of plow-shaped mixing elements which are mounted radially from a central drive shaft. Upon rotation of the central drive shaft, the plow-shaped elements sweep out an annular volume in proximity to the inner wall of a drum to cause the material to be thrown up and away from the inner wall of the drum toward the central drive shaft to produce substantial mixing action. Horizontal mixers may additionally include a deagglomerating impeller which projects orthogonally inward from the inner surface of the mixing drum toward the central drive shaft for use in controlling particle size and the dispersing of viscous liquids within the drum.

Mixers are also known which have a vertically projecting central drive shaft upon which a vertical impeller is mounted at the bottom of the mixing chamber. The drive mechanism for the drive shaft of the vertical impeller may be projected upward from below the bottom of the mixing chamber or projected downward from above the mixing chamber. Typically for mixing liquids, the drive shaft is projected downward from a drive mechanism located above the top of the mixing chamber and is rotated at high speeds such as 3000 rpm. Typically for producing vortex mixing suited for granulation, the drive shaft is projected upward from a drive mechanism located below the mixing chamber and is rotated in the range of 500 to 600 rpm.

Each of the above-described prior art mixing systems are available as special purpose mixers designed for performing a single type of mixing action. Because of the design of these mixers to perform a single mixing operation, they are not suited for the performing of diverse types of mixing operations for the mixing of solids and liquids which require a drive shaft for driving mixing elements to be positioned in either horizontal or vertical orientations. Therefore to perform the above-described diverse mixing operations it is necessary to have special purpose mixers dedicated to performing only one type of mixing operation with the concomitant high expense associated with the purchase of separate pieces of equipment.

Mixing equipment is commercially available for performing granulation which has a mixing chamber that is rotatable through an angle of approximately 60°. This mixer has a mixing arm which is rotated in two directions under the control of a variable speed adjustment. This mixer is designed for the single purpose of granulation. The mixer is not positionable in horizontal and vertical orientations for performing diverse mixing oprations requiring mixing elements to be positioned in these angular orientations.

SUMMARY OF THE INVENTION

The present invention is a multipurpose mixer for performing diverse types of mixing, granulation, drying, reactions, and filtration with a single piece of equipment. The different mixing actions and additional processes are accomplished with the present invention by a system which permits special purpose mixing elements designed for particular types of mixing actions to be mounted and dismounted from a central drive shaft and a mechanism for rotating the mixing drum around an axis of rotation orthogonal to the central drive shaft to permit the mixing drum to be locked in at least distinct horizontal and vertical orientations. A special purpose mixing element assembly is mounted on the drive shaft for each distinct type of mixing operation which is to be performed while the mixing drum is locked in at least horizontal or vertical orientations. The invention is further useful when the mixing chamber is locked in distinct angular positions for performing aspiration of fluid materials from the interior of the mixing drum with filtration of the fluid by the application of a vacuum source, vacuum drying with filtration, atmospheric drying by the forcing of hot air into the mixing chamber with filtration, reflux reactions and column processes.

The present invention has at least the following advantages: The cost of the present invention is much less than the cost of purchase of special purpose machines for performing diverse mixing functions. The present invention achieves efficient utilization of space for performing diverse types of mixing. The present invention eliminates product cross-contamination consequent from processing a product with diverse mixing and other operations in one machine which is of critical importance in pharmaceutical, food and chemical processing. Material handling time and cost for performing diverse mixing functions is reduced by processing in one mixing chamber. Highly viscous products are easily added to and emptied from the drum by a combination of tilting and removal of the entire first end. Set up time to convert the mixer from horizontal to vertical mixing modes or vice versa is minimal as a consequence of the removable first end and the locking mechanism.

A multipurpose mixer in accordance with the invention includes a drum having first and second ends, the first end of the drum being closed during operation and being openable from its closed position for permitting access to the interior of the drum to permit the replacement of mixing elements mounted on a drive shaft contained within the drum which are designed for performing particular types of operations when the drum is disposed at particular angular orientations, the first end of the drum having a port with a closure, which is openable from a closed position, used during operation to permit the addition of materials into the drum and the removal of materials from the drum. The drive shaft is disposed axially within the drum, rotatably supported in the second end of the drum, and has an extension through the second end for attachment to a motor for rotating the drive shaft. The motor rotates for performing particular types of mixing operations. The drum is rotatable around an axis of rotation through a range of angular orientations with the axis of rotation being orthogonal to the drive shaft. A lock is provided for locking the drum in any one of a plurality of angular orientations which permit the drive shaft to be positioned in at least horizontal and vertical orientations. Horizontal mixing may be accomplished when the drive shaft is locked in a horizontal position with a plurality of plow-shaped mixing elements or when other special purpose mixing elements are coupled to the drive shaft at spaced apart locations. Vertical mixing may be accomplished with the drive shaft locked in a vertical orientation with either the first end of the drum being on top of the drum or on the bottom of the drum with special purpose mixing elements coupled to the drive shaft.

Preferably the port is located near the periphery of the first end at a point offset from the drive shaft and includes a cylindrical section having two ends with one end joined to the first end of the drum and communicating with the interior of the drum and the other end having the closure which is openable from the closed position to add and remove materials from the drum.

The present invention may be used for filtrating materials which are being mixed within the drum under the action of "horizontal type" mixing elements which are attached to the drive shaft. To perform this filtration function, the drum is locked into an inclined position with the first end located below the drum. A filter screen is disposed within the drum at a position offset from the first end by a plurality of sections which form channels between the screen and the first end to permit fluid to be aspirated along the channels out of the port. A scraper is attached to the drive shaft at a position adjacent to the screen for lifting material away from the screen to permit the screen to be maintained in an unclogged condition so that fluids may be readily drawn out of the material being mixed within the drum.

The present invention is used to perform vacuum drying by orienting the drum in a position with the drive shaft inclined with the first end on top of the drum. A plurality of "horizontal type" mixing elements are coupled to the drive shaft at spaced apart locations. A vacuum source is coupled to the port with the closure opened for aspirating the interior of the drum. A filter element is disposed within the drum for filtering any particulate material from being aspirated from the drum by the vacuum source. Preferably, the filter element is located within a zone in which no mixing elements are located. The drum may have two sections which are joined together with the first section containing the "horizontal type" mixing elements and the second section defining the zone where no mixing elements are located and where the filter element is located.

The present invention may also be used to perform hot air drying of material being mixed within the drum. The drum is locked in an angular orientation with the first end of the drum being on top of the drum. A plurality of "horizontal type" or other type mixing elements are coupled to the drive shaft at spaced apart locations for producing mixing action of material contained within the drum. The hot air source is coupled to the drum for forcing hot air into the interior of the drum. A filter element is provided for filtering hot air flowing out of the drum through the port when the closure is removed. Preferably, the drum extends past the drive shaft to define a zone in which no mixing elements are located and the hot air source is coupled to the zone where no mixing elements are located. Preferably the filter element is a bag-type element and the drum is comprised of two sections which are joined together with the first section containing the mixing elements and the second section defining the zone where no mixing elements are located and the filter element is located.

DESCRIPTION OF THE PREFERRED EMBODIMENT

Figure 1:
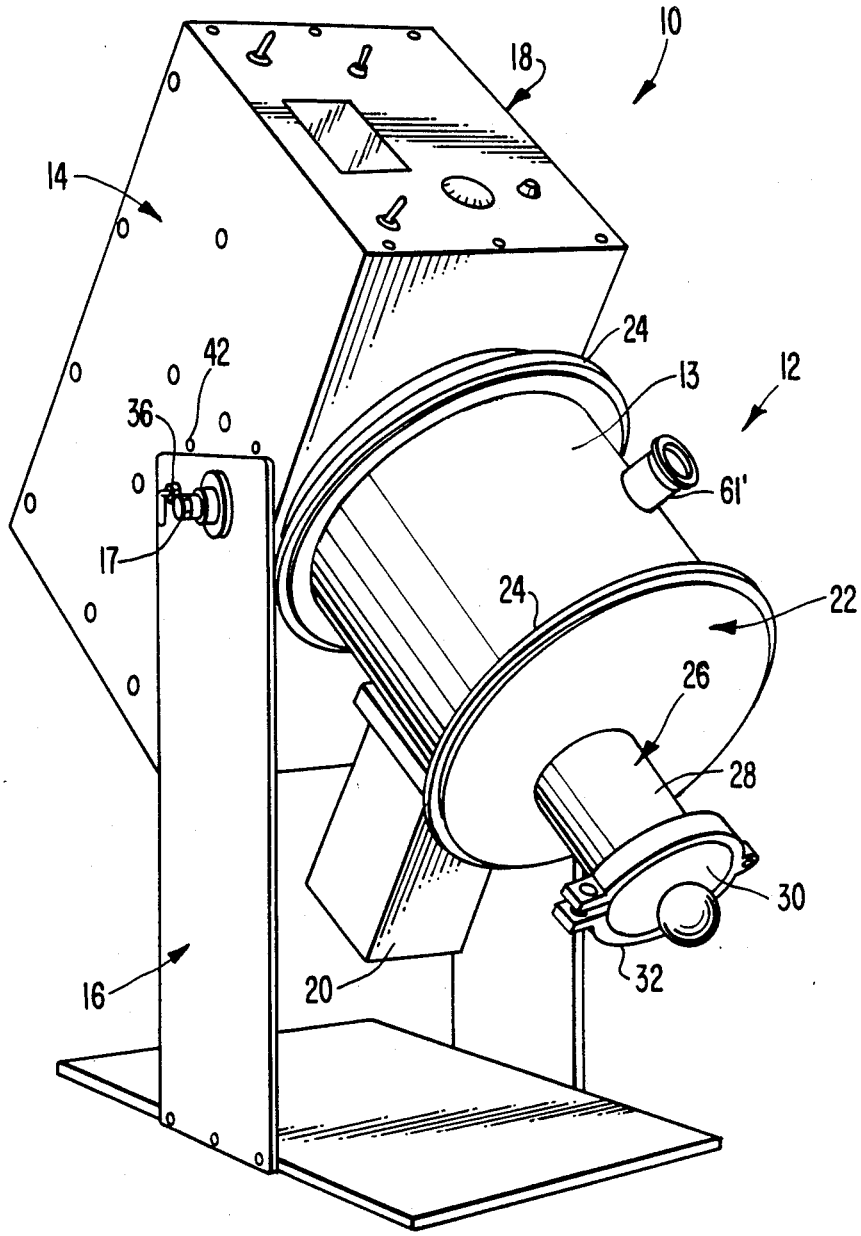
FIG. 1 is a perspective view of the present invention.
Figure 4:
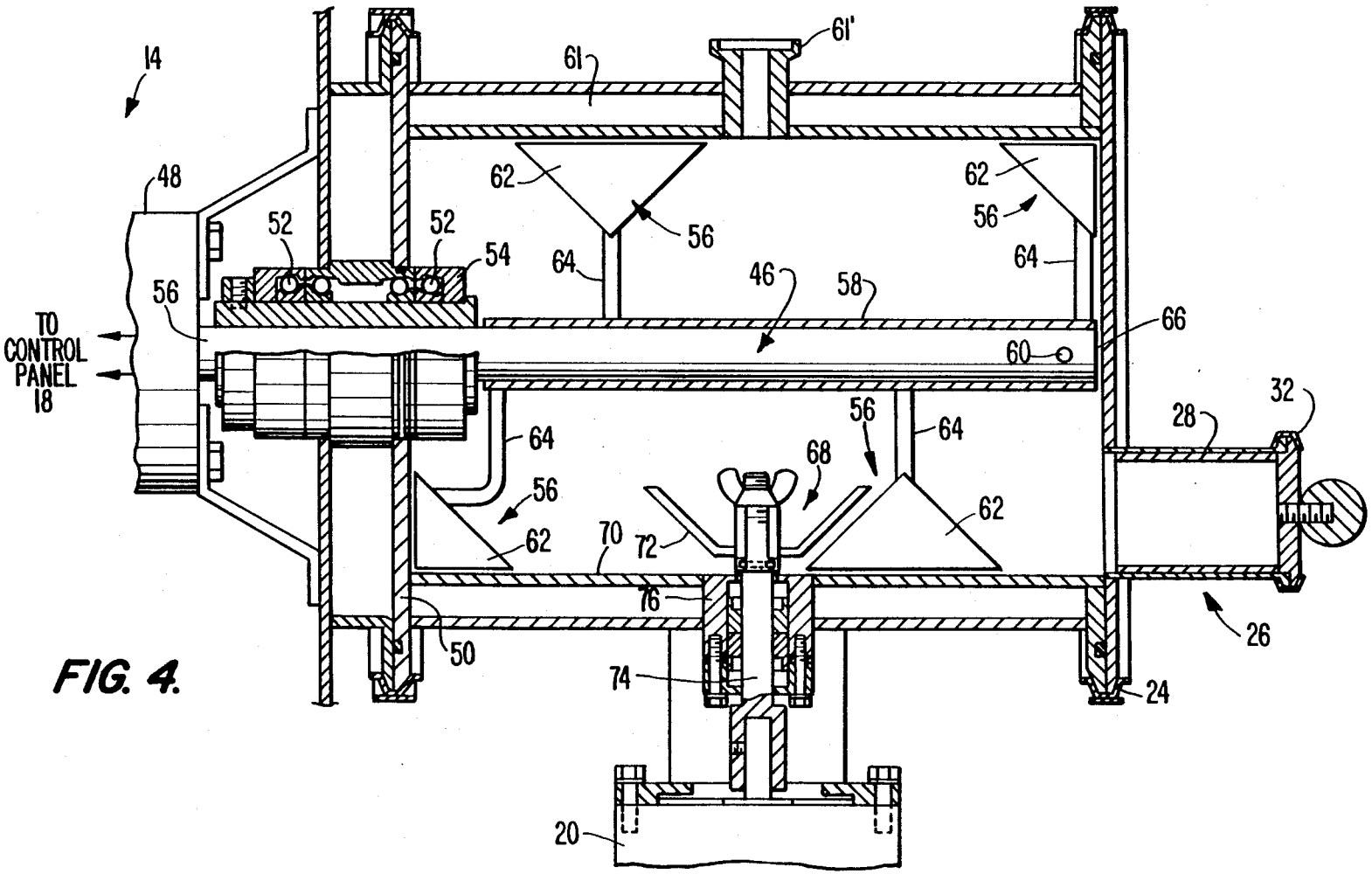
FIG. 4 is a sectional view of the drum with mixing elements used for horizontal mixing.

FIG. 1 illustrates a perspective view of the present invention 10 before it has been positioned in an angular orientation for performing a specific mixing operation. The main parts of the invention are a drum assembly 12, including a driven main axial drive shaft (not illustrated), a main housing 14, and detent pin mechanism 17 for locking the drum in any one of a plurality of angular positions. A support stand 16 is provided which supports the axis of rotation 17 of the driving assembly 12. A control panel 18 contains controls for activating and controlling the speed of two motor drives used by the present invention and an ammeter used for monitoring the current draw by the motor which drives the main drive shaft located axially within the drum assembly 12. Preferably the motor for driving the main driven shaft (FIG. 4) is of variable speed with at least two selectable speeds to permit the drive shaft to be driven at speeds designed for diverse types of mixing operations as described below. The second motor drive 20 extends through the outside wall of the drum assembly orthogonally into the chamber formed by the drum for driving a high sheer deagglomerating impeller (FIG. 4). The drum has a first end 22 which is removable from cylindrical section 23. A clamp 24 is attached to the outside cylindrical section 23 and the first end 22 of the drum assembly 12 to lock the first end in place during operation. The clamp 24 also locks the drum assembly 12 to the main housing 14. The part of the clamp 24 which clamps the first end of the drum in place is openable to permit the first end to be removed to place mixing element assemblies on the main drive shaft as explained in detail below with regard to FIGS. 4–9. The first end 22 of the drum assembly 12 includes a port 26 which is located near the periphery of the first end at a position offset from the centrally disposed drive shaft (FIG. 4). The port 26 includes a hollow cylindrical section 28 which has a first end which communicates with the interior of the drum assembly 12 and a second end having a closure 30 which is removable to permit materials to be placed inside of and removed from the drum assembly 14. Typically, the materials are added to the drum while it is in its "vertical up" position and removed when it is in its "vertical down" position. The closure 30 is held in place by a clamp 32. A plurality of holes 42 are drilled in the side panel of the main housing 14 for receiving the detent pin assembly 30 mounted in the upright portion of the support stand 16. It should be understood that the details of the controls for the motor drives are conventional and are therefore not illustrated except to the extent necessary to understand the overall operation of the invention as described herein.

Figure 2:
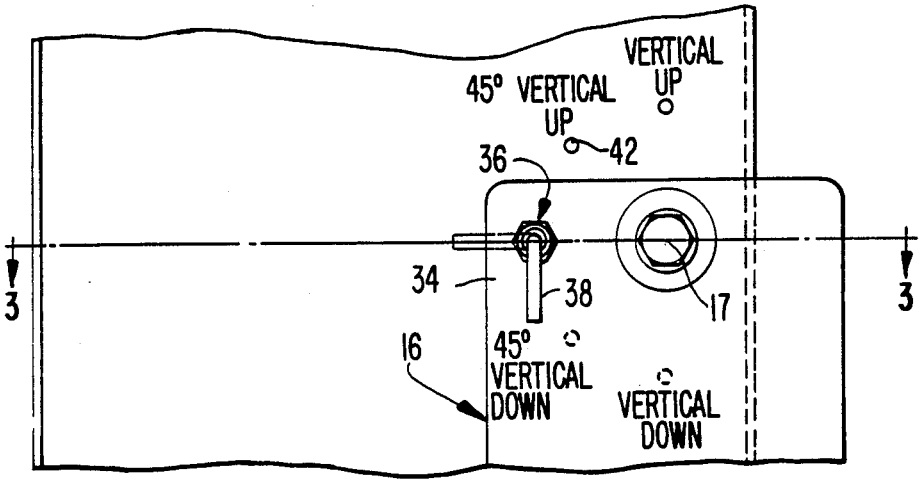
FIG. 2 is a side view of the locking mechanism and pivot axis for the drum assembly.
Figure 3:
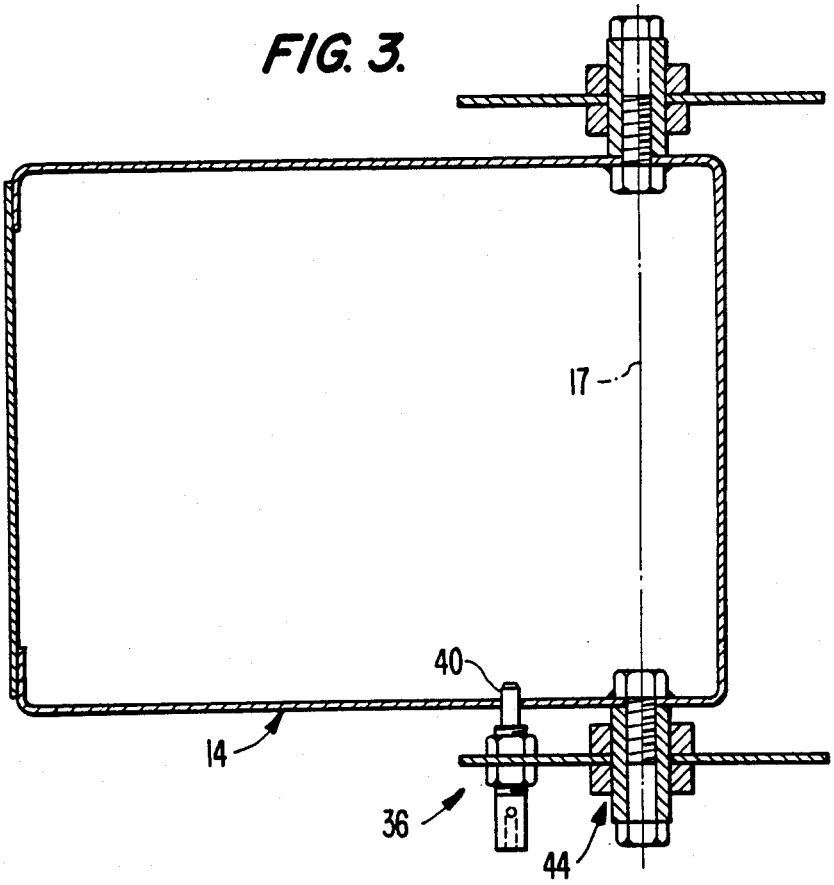
FIG. 3 is a sectional view of FIG. 2 taken along section line 3—3.

FIGS. 2 and 3 illustrate the preferred form of locking mechanism for locking the drum assembly 12 in a plurality of distinct angular orientations useful for performing distinct types of mixing operations as described below. FIGS. 2 and 3 do not illustrate the drum assembly 12. It should be understood that the drum assembly 12 rotates in unison with the rotation of the main housing 14. The upper portion 34 of the support stand 16 carries a detent pin mechanism 36 which includes a handle 38 joined to a detent pin 40 which projects inward from the upper portion 34 of the support stand 16 to engage any one of a plurality of holes 42 which are drilled in the main housing 14. Preferably, the holes 42 are positioned at 45° increments on a semicircle to permit rotation of the main housing 14 and drum assembly 12 through 180°. Additional holes 42 may be added to permit fixed angular positions within the 180° of rotation, as illustrated, or to permit additional angular orientations out of the 180° of rotation as illustrated. The main housing 14 is rotatably supported in the upper portion 34 of support stand 16 by a rotary support 44 of conventional design. When the pin 40 is removed, the main housing 14 and drum assembly 12 are free to rotate around the pivot axis 17. While the preferred form of locking mechanism has been described, it should be understood that other locking mechanisms may be used for locking the main housing 14 and drum assembly 12 at fixed angular orientations to practice the present invention.

FIG. 4 illustrates a sectional view of the present invention used in the horizontal mixing mode. The drive shaft 46 is driven by a variable speed motor 48 which is controlled from the control panel 18. The drive shaft 46 is rotatably supported in the second end 50 of the drum assembly 12 by a bearing 52. A seal 54 is provided for preventing the bearing 52 from being contacted by materials being mixed within the drum assembly 12. The drive shaft 46 has an extension 56 which is coupled to the variable speed motor 48 to couple rotary motion to the mixing elements 56 which are attached at spaced apart locations to a hollow cylindrical sleeve 58 which has an inner surface which contacts the outer surface of the drive shaft 46. A hole 60 is diametrically drilled through the cylindrical sleeve 58 and the drive shaft 46 for receiving a pin (not illustrated) for locking the cylindrical sleeve 58 which drives the mixing elements 56 to the drive shaft 46. Preferably, the mixing elements 56 are plow-shaped elements of well-known construction. The cylindrical section 23 is of double walled construction to form a jacket 61 useful for applications requiring heating or cooling. The port 61' is coupled to a suitable heat or cooling source to control the temperature of the mixing chamber. Each element 56 contains at least one sloped surface 62 which is inclined upward toward the drive shaft 46 to impart lift to materials being contacted by rotation of the mixing element. The individual mixing elements 56 are attached to the hollow cylindrical sleeve 58 by radial arms 64. The arm 64 located closest to the second end 50 of the drum assembly 12 has a 90° bend to permit the attachment point to the hollow cylindrical sleeve 58 to be axially offset from the position of the mixing element within the drum assembly 12. The remaining three arms 64 are straight. The end of the drive shaft 46 is offset slightly from the first end 22 of the drum assembly. A deagglomerating impeller 68 projects orthogonally inward from the inner wall of the drum assembly 12 at a point midway between the first end 22 and the second end 50. The deagglomerating impeller 68 includes a blade assembly 72 which is attached to a drive shaft 74 which is coupled to motor 20. The deagglomerating impeller drive shaft 74 is sealed against leakage by a sealing assembly 76. The deagglomerating impeller 68 is used to control particle size of materials being mixed within the drum assembly 12 and to disperse any liquids. While the present invention is preferably used to perform horizontal mixing with the mixing element assembly as illustrated, it should be understood that other mixing element assemblies may be used which are designed for mixing particular materials or performing particular types of mixing actions while the drive shaft 46 is in the horizontal position.

Figure 5:
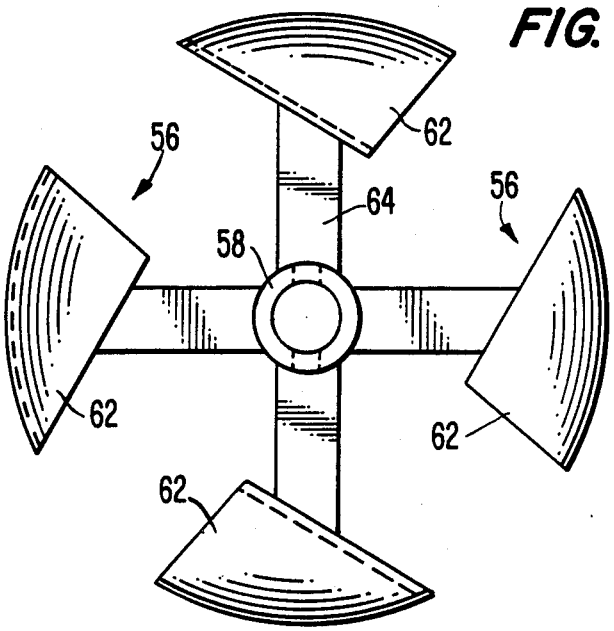
FIG. 5 is a top view of the mixing blade assembly used for horizontal mixing.

FIG. 5 illustrates a top view of the preferred form of mixing element assembly used for mixing with the drive shaft 46 in a horizontal orientation. As illustrated, the mixing elements 56 are intended to rotate in a counterclockwise direction so that the highly sloped surface 62 imparts substantial lift to materials which are contacted during rotation.

Figure 6:
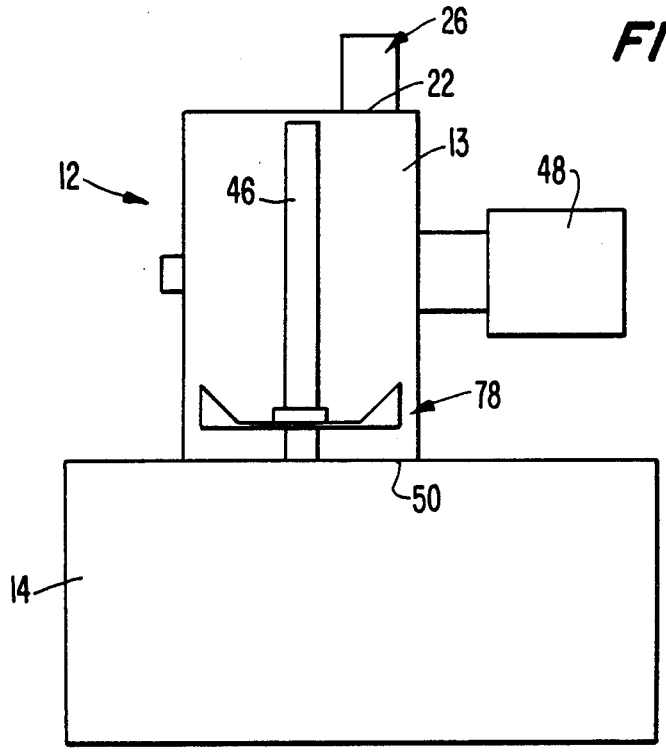
FIG. 6 is a schematic view of the present invention used for vertical mixing with the first end of the drum located on top of the drum.

FIG. 6 is a schematic view of the present invention 10 used for performing vertical "up" mixing. The drum assembly 12 has been illustrated schematically for the reason that it is identical to the assembly as illustrated in FIG. 4 with the exception that the blade assembly has been replaced by removal of first end 22 and the drive shaft 46 has been rotated to a vertical orientation with the first end 22 of the drum assembly 12 above the cylindrical section 13. The specifics of the impeller mixing element assembly are discussed in conjunction with FIGS. 8 and 9 below. The drive shaft 46 is locked in the vertical "up" mode by positioning of the detent pin 40 in the hole 42 of FIG. 2 labelled "vertical 'up' mode". The vertical "up" mode of mixing is used primarily for granulation purposes. Typically, high mixing is performed by rotating the drive shaft 46 at a speed such as 500 rpm while using an impeller mixing element assembly 78 having a high lift to impart violent mixing action to the product contained within the drum assembly 12. The choice of speed for driving the drive shaft 46 and the design of the impeller mixing element assembly 78 are not part of the present invention. With the vertical "up" mode of mixing, the impeller blade assembly 78 is attached to the drive shaft 46 at a position slightly offset from the second end 50 of the drum assembly 12.

Figure 7:
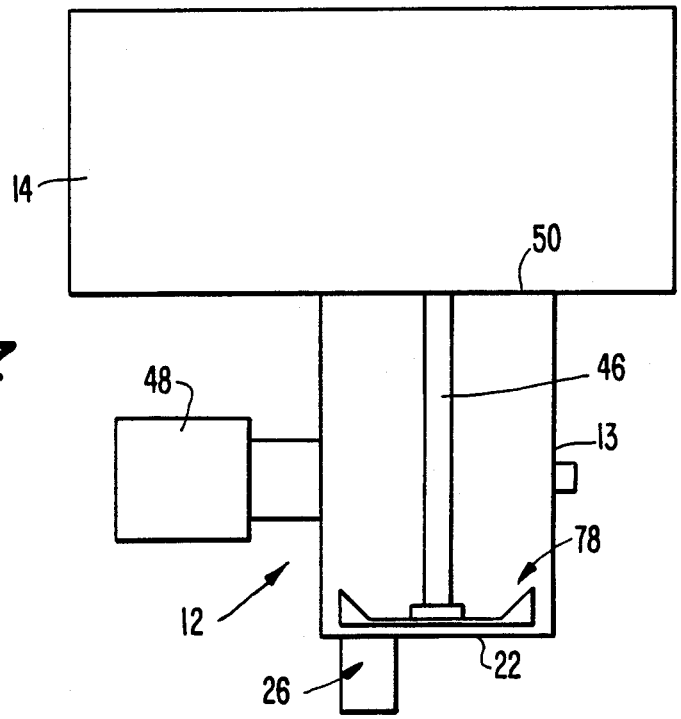
FIG. 7 is a schematic view of the present ivention used for vertical mixing with the first end of the drum located below the drum assembly.

FIG. 7 illustrates a schematic of the present invention 10 used for vertical "down" mixing. Identical reference numerals are used to identify parts which are common to the drawings discussed above. The vertical "down" mode is identical to the vertical "up" mode discussed above in conjunction with FIG. 6 except that the orientation of the drive shaft 46 has been rotated 180° and the impeller blade assembly 78 has been attached to the end of the drive shaft adjacent to the first end 22 of the drum assembly 12. Prior art usage of the vertical "down" mode of mixing (in which the power drive for the drive shaft 46 is located above the drum assembly 12) has been to produce high speed liquid mixing. In this mode of operation, the drive shaft 46 is typically driven approximately 3000 rpm and an impeller mixing element assembly 78 is used which has more lift than the impeller mixing element assembly used for vortex liquid mixing in the vertical "up" mode discussed above with regard to FIG. 6. It should be understood that both the vertical "up" and "down" modes may be used to perform identical functions by the choice of a suitable speed for rotating the drive shaft 46 in conjunction with the choice of a suitable impeller mixing element assembly 78. In the vertical "down" mode of mixing, the impeller mixing element assembly 78 is attached to the end of the drive shaft 46 in proximity to the first end 22 of the drum assembly 12.

Figure 8:
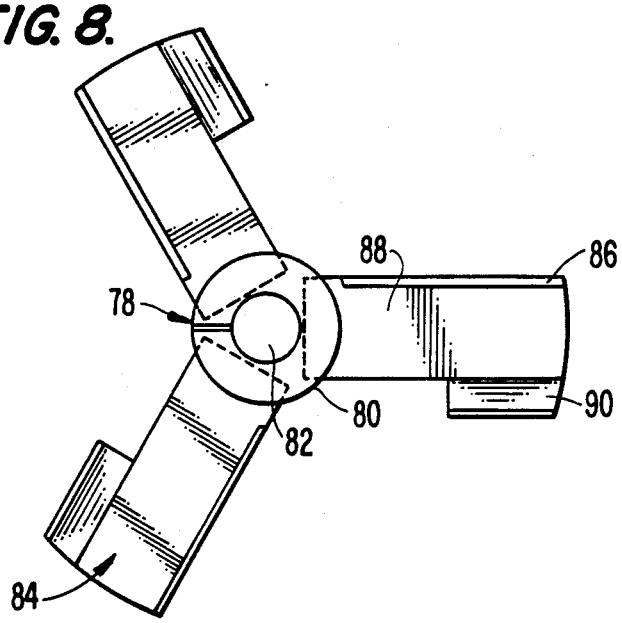
FIG. 8 is a top view of an impeller mixing element assembly useful for the mixing configuration of FIG. 6.
Figure 9:
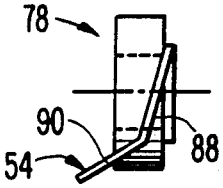
FIG. 9 is a side view of the impeller mixing element assembly of FIG. 8.

FIGS. 8 and 9 illustrate a suitable impeller mixing element assembly 78 which may be used for the vertical "up" and "down" modes described above in conjunction with FIGS. 6 and 7. It should be understood that typically the degree of lift in the individual element of the impeller mixing element assembly 78 used for high speed liquid mixing is higher than the degree of lift used for individual elements in vortex mix action used for granulation. The mixing element assembly 78, as illustrated in FIGS. 8 and 9, is designed for high speed liquid mixing but it should be understood that it may be modified for vortex mix action by reducing the degree of lift for the individual blade elements. The mixing element assembly 78 has a collar 80 with a centrally disposed annulus 82 of a dimension which fits snugly over the drive shaft 46. The collar 80 is locked to the drive shaft 46 in the positions illustrated in FIGS. 6 and 7 above by a suitable locking mechanism such as a set screw (not illustrated). Individual mixing elements 84 are attached to the collar 80 to project radially outward. Each mixing element 84 has a sharpened edge 86 which is designed to contact the material being mixed. The sharpened edge 86 is a part of a first inclined surface 88 which is typically inclined with an angle of approximately 15° from the vertical as illustrated in FIG. 9. A second surface 90 is joined to the first surface 88 to define an angle of approximately 45° between the two surfaces. The second surface 90 is intended to impart a high degree of lift useful for high speed liquid mixing. The degree of lift of the first and second surfaces 88 and 90 would typically be reduced when vortex mix action useful for granulation is being performed.

Figure 10:
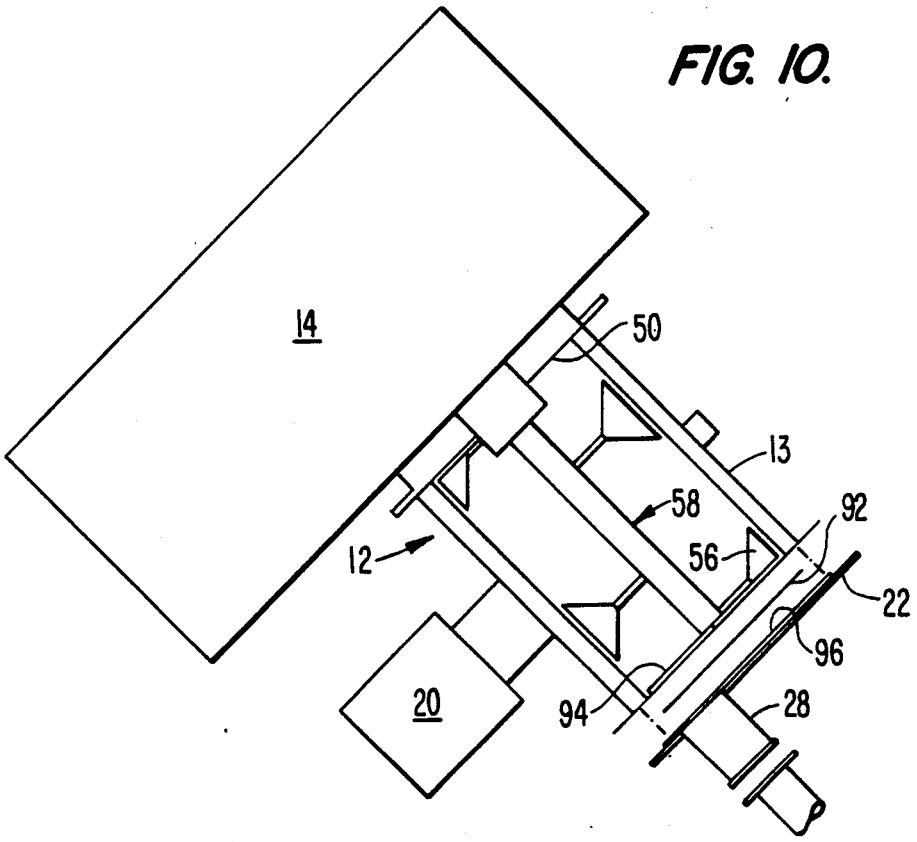
FIG. 10 is a schematic view of the present invention used for vacuum aspiration of the interior of the drum during mixing.
Figure 11A:
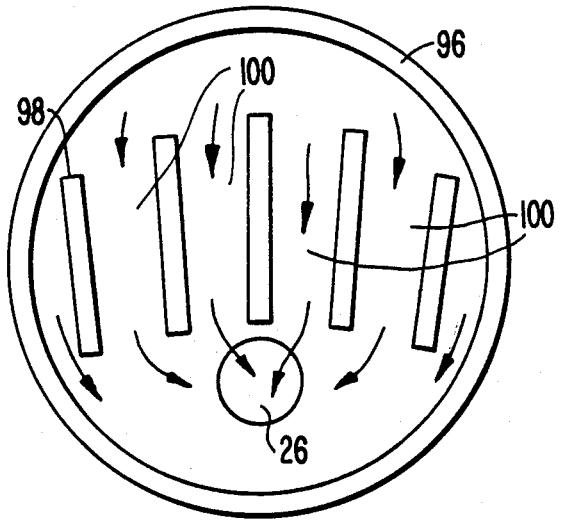
FIG. 11A is a view of the first end 22 of the drum of FIG. 10 illustrating channels formed for permitting fluid flow from the interior of the drum to the port with the filter element omitted.

FIGS. 10 and 11 illustrate the present invention used for vacuum aspiration of the drum assembly 12 with filtration during mixing. Identical reference numerals are used to identify parts common to the invention as described above. As illustrated, the detent pin 40 is positioned in the hole 42 of FIG. 2 labelled "45° vertical 'down' mixing". In addition to the structure described above, a filtration screen 92 is provided between the first end 22 of the drum assembly 12 and the drum section 23. The size of the openings provided in the filtration screen is a matter of design choice and is intended to prevent the aspiration of substantial particulate material from the mixing chamber while permitting fluids to be aspirated from the chamber. The horizontal mixing element assembly is modified from that illustrated in FIG. 4 to the extent that an additional scraper blade 94 is attached the cylindrical sleeve 58 diametrically opposite the individual element 56 which is located adjacent to the first end 22. The scraper 94 scrapes away from the surface of the screen 92 particles which would otherwise make it difficult to aspirate fluid from the drum because of occluding of the holes in the filtration screen. It should be understood that other types of filtration elements may be used instead of the filtration screen 92. A suitable gasket 96 is attached to the first end 22 of the drum assembly 12. The purpose of the gasket is twofold in providing a tight seal against fluid leakage and to offset the filter screen 92 from the inner surface of the end 22 which in conjunction with sections 98, as illustrated in FIG. 11A, form a plurality of channels which run toward port 28. As illustrated in FIG. 11A, fluid passing through the screen (not illustrated) collects in the channels 100 and flows to the port 26 where it is aspirated out in response to the suction from a vacuum source (not illustrated) which is connected to the cylindrical section 28. This embodiment of the invention is particularly useful for aspirating solvents from materials being mixed.

Figure 12:
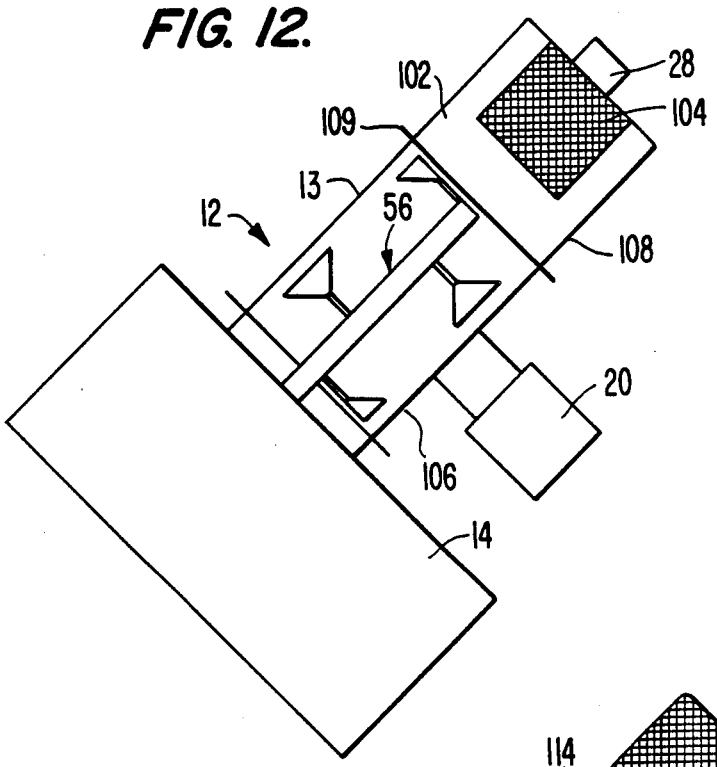
FIG. 12 is a schematic view of the present invention used for vacuum drying.

FIG. 12 illustrates the use of the present invention to vacuum dry materials being mixed or wet granulated within the drum assembly 12. Identical reference numerals are used to identify parts which are identical to those described above. The drum assembly is locked in the position illustrated in FIG. 12 by the positioning of the detent pin 40 in the hole 42 labelled "45° vertical 'up' mixing" as illustrated in FIG. 2. The hollow cylindrical section 28 is connected to a suitable vacuum source (not illustrated). The drum 13 is elongated to create a zone 102 in which the mixing element assembly 56 is not located. A filtration element 104 is located within the zone 102. The filtration element 104 may be of any suitable design for preventing the aspiration of fine particles from the drum assembly 12 while permitting fluids or vapors to be aspirated therefrom. Preferably, the drum 13 is made from a first section 106 and a second section 108 which are joined together by a suitable clamp 109 similar to the rim-type clamp 24 as illustrated in FIG. 4.

Figure 13:
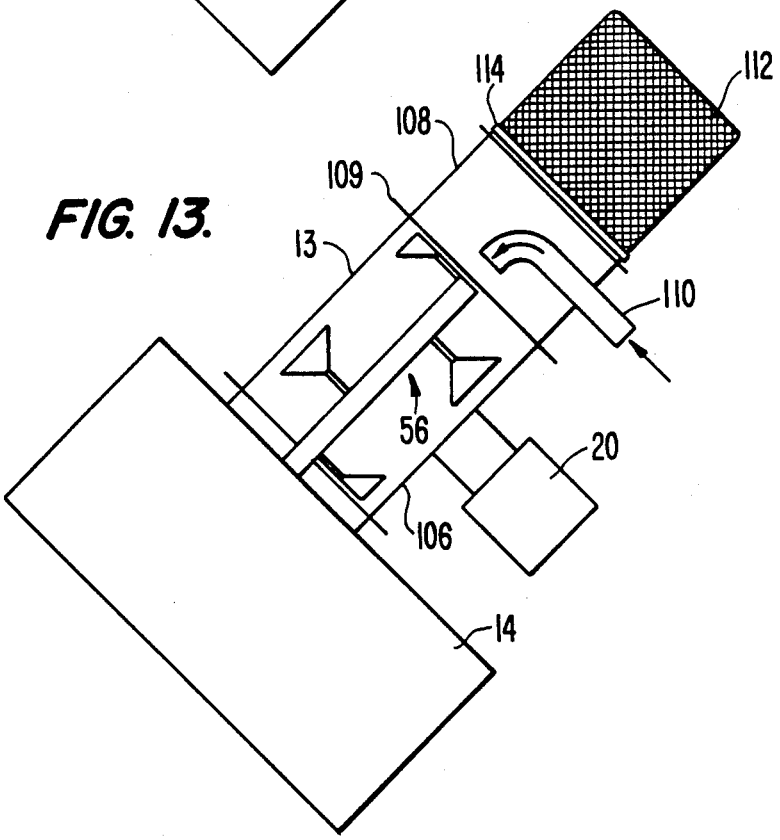
FIG. 13 is a schematic view of the present invention used for hot air drying, after wet granulation.

FIG. 13 illustrates the use of the present invention to perform hot air atmospheric drying while mixing. The structure of the invention in FIG. 13 is identical to that of FIG. 12 with the exception that a suitable hot air manifold 110 is connected to the second section 108 of the cylindrical section 13 to provide forced hot air from a hot air source (not illustrated). Additionally, a bag-type filter element 112 is connected to the outside of the first end 22 of the drum assembly 14 for trapping any particulate material being blown out of the drum assembly 12 in response to the forced induction of hot air. An exterior clamp 114 is provided for attaching the bag-type filter element 12 to the first end 22 of the drum assembly 12.

Figure 14:
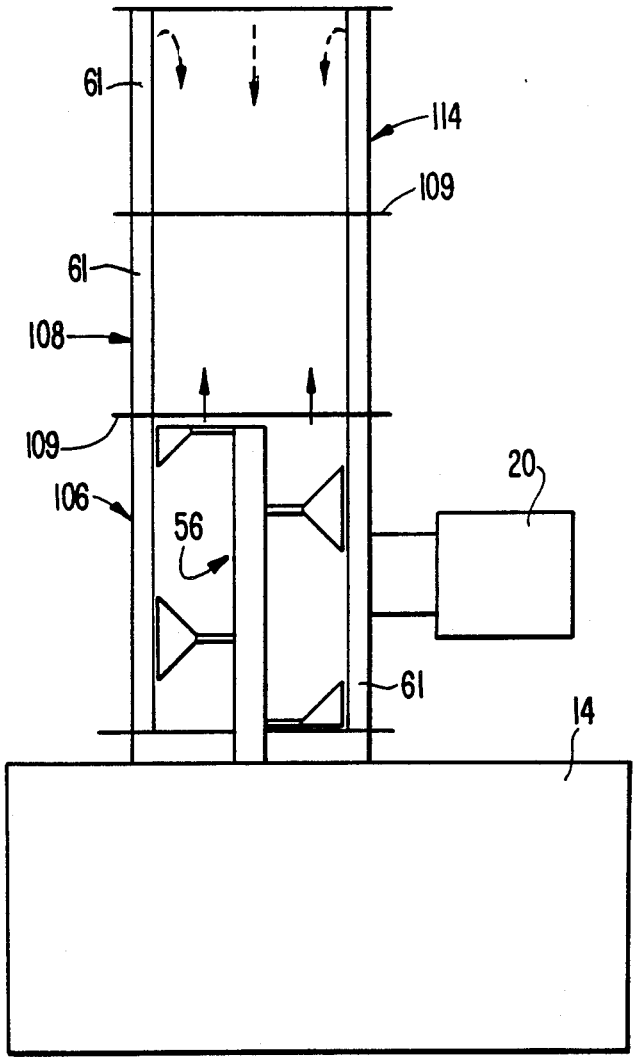
FIG. 14 is a schematic view of the present invention used for performing reflux reactions or column operations.

FIG. 14 illustrates the use of the invention to perform reflux reactions or column operations. Identical reference numbers are used to identify parts described above. As illustrated, the drum assembly 14 is locked in a vertically upward orientation by the insertion of pin 40 in the hole 42 labelled "vertical 'up' mixing" of FIG. 2. Additionally, the jacket 61 of the section 106 is connected to a suitable source of heat for applying heat in the primary mixing area of the drum assembly 12. The successive stages 108 and 114 are cooled by the application of a suitable refrigeration source to their jackets 61. Heating of the primary mixing zone in combination with the rotation of the mixing assembly 56 causes hot vapors to rise into the cooled sections 108 and 114. As the hot vapors rise into the cooled sections, they are cooled and condensed against the first end 22 to produce reflux condensation. The condensed liquid then drops back down into the primary mixing section 106.

EXAMPLE

A cellulosic product is to be ground into a smaller particle size prior to washing. The cellulosic product is added to the mixing assembly in its natural form in chunks. The present invention, with the aid of water as a grinding media, is operated as a mill with the motor 20 operated at approximately 5000 rpm and the motor 48 operated at approximately 400 rpm. The product is liquefied in approximately 10 minutes. This operation may be performed with the main drive shaft 46 in either a horizontal or a vertical mode as described above. A suitable mixing element assembly is positioned on the drive shaft 46 by removal of the first end 22 of the drum assembly 12.

Figure 11B:
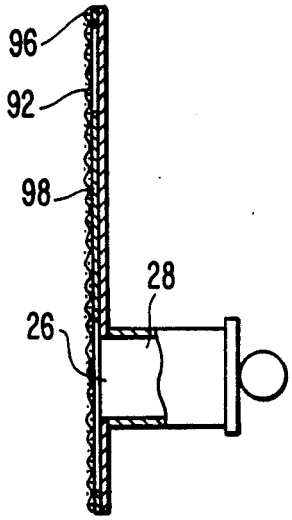
FIG. 11B is a side view of the end of the drum of the invention as illustrated in FIG. 10.

The product as described above is filtered to separate some of the impurities. A vacuum source of approximately 20 inches with a screen size of 50 mesh is used to operate the invention as illustrated in FIGS. 10, 11A and 11B. Five to ten minutes of processing is sufficient to accomplish this phase.

The product as described above is washed with a solvent and slurried with intensive mixing and milling action to loosen all impurities. The washing and slurrying operation can be accomplished by the operation of the drive shaft 46 in a horizontal mode. Thereafter filtration as described above is accomplished.

The product as described above is processed to add either alkali or acid materials to control the resultant pH. The drum assembly 12 is tilted to a 45° upward position by positioning of the pin 40 in the hole labelled "45° vertical 'up' mixing" of FIG. 2. The upward position facilitates the addition of the liquid acidic or basic material.

The drum assembly 12 is charged with additional chemical materials to modify the cellulose that has been purified as described above. In this phase the drum assembly 12 is tilted to the "vertical 'up' mixing" position by insertion of the pin 40 in the appropriately labelled hole 42 of FIG. 2. In this phase, reactants are added and the internal pressure increases due to an exothermic reaction. The jacket of the vessel 61 is connected to a suitable refrigeration source to control the reaction temperature. Temperature control is important in preventing excessive heat which could damage the resultant product.

To further modify the resultant product, additional stages are added as illustrated in FIG. 14. The lowest drum is heated with mechanical agitation being applied by rotation of the mixing elements 56 by power applied by the drive shaft. Vapor is caused to rise by the action of heating and agitation into contact with the upper stages. Cooling is applied to the upper stages which causes the vapor to condense and fall as droplets back into the bottom heated stage where further reaction takes place. Thereafter the product is worked and filtered several times with the drum being in the position with the agitator at the bottom stage of the drum.

The drum is equipped with a vacuum dryer as illustrated in FIG. 12. The product is dried to zero percent moisture.

The product is emptied from the drum in the vertical down position with the first end 22 being at the bottom of the drum.

While the invention has been disclosed in terms of its preferred embodiment, it should be understood that numerous modifications may be made thereto without departing from the spirit and scope of the invention as defined in the appended claims. It is intended that all such modifications fall within the scope of the appended claims.

I claim:

1. A multipurpose mixer comprising:

(a) a drum having first and second ends, the first end of the drum being closed during mixing operation and being openable from its closed position for permitting access to the interior of the drum to permit replacement of mixing elements mounted on a first drive shaft contained within the drum, the elements being designed for performing particular types of mixing operations when the drum is disposed at particular angular orientation including the performing of at least one type of mixing operation with the first drive shaft disposed at a horizontal orientation and at least one other type of mixing operation with the first drive shaft disposed in a vertical orientation, the first end of the drum having a port with a closure which is openable from a closed position used during operation to permit the addition of materials into the drum and the removal of materials from the drum;

(b) the first drive shaft being disposed axially within the drum, rotatably supported in the second end of the drum, and having an extension through the second end for attachment to a motor to rotate the drive shaft;

(c) a motor coupled to the extension of the drive shaft for rotating the drive shaft;

(d) means for pivoting the drum around an axis of rotation through a range of annular orientations, the axis of rotation being orthogonal to the first shaft; and (e) means for positioning the drum in any one of a plurality of angular orientations, the means for positioning permitting the selective positioning of the drum in angular orientations which position the first drive shaft in at least a horizontal and in a vertical orientation.

2. A multiple purpose mixer in accordance with claim 1 wherein:

(a) the means for positioning locks the drum into an angular orientation with the first drive shaft disposed in a horizontal orientation; and (b) a plurality of plow-shape mixing elements are coupled to the first drive shaft at spaced apart locations.

3. A multipurpose mixer in accordance with claim 2 wherein:

(a) the mixing elements are attached to a hollow cylindrical section at spaced apart locations by arms, the hollow cylindrical section having a cylindrical surface with a hole for receiving a pin;

(b) the hollow cylindrical section being placed over the drive shaft;

(c) the drive shaft having a cylindrical surface with a hole therein which accepts a pin for locking the hollow cylindrical section to the drive shaft; and (d) a pin extending through the hole in the hollow cylindrical section into the hole in the drive shaft for locking the hollow cylindrical section to the drive shaft.

4. A multiple purpose mixer in accordance with claim 1 wherein:

(a) the means for positioning locks the drum into an angular orientation with the first drive shaft disposed in a vertical orientation with the first end of the drum being located on top of the drum; and (b) an impeller assembly is attached to the first drive shaft adjacent to the second end of the drum.

5. A multipurpose mixer in accordance with claim 4 wherein:

(a) the impeller assembly comprises a collar with a central annulus which fits over the drive shaft with an inner cylindrical surface of the collar engaging an outer surface of the drive shaft and a plurality of impeller elements joined to the outer surface of the collar; and (b) means for locking the collar to the drive shaft.

6. A multiple purpose mixer in accordance with claim 1 wherein:

(a) the means for positioning locks the drum into an angular orientation with the first drive shaft disposed in a vertical orientation with the first end of the drum being located below the drum; and (b) an impeller assembly is attached to the first drive shaft adjacent to the first end of the drum.

7. A multipurpose mixer in accordance with claim 6 wherein:

(a) the impeller assembly comprises a collar with a central annulus which fits over the drive shaft with an inner cylindrical surface of the collar engaging an outer surface of the drive shaft and a plurality of impeller elements joined to the outer surface of the collar; and (b) means for locking the collar to the drive shaft.

8. A multipurpose mixer in accordance with claim 1 wherein:

(a) the drum has an interior surface and further comprising;

(b) at least a second drive shaft extending from a point outside the drum orthogonally into the interior of the drum with respect to the interior surface at a spacing approximately midway between the first and second ends to provide milling and chopping action;

(c) a motor coupled to the second drive shaft for driving a deagglomerating impeller; and (d) a deagglomerating impeller coupled to the second drive shaft at a position within the interior of the drum.

9. A multipurpose mixer in accordance with claim 1 wherein:

(a) the port is located near the periphery of the first end at a point offset from the first drive shaft; and (b) the port is comprised of a cylindrical section having two ends with one end joined to the first end of the drum and communicating with the interior of the drum and the other end having the closure.

10. A multipurpose mixer in accordance with claim 9 wherein:

(a) the means for positioning locks thee drum into an angular position with the drive shaft inclined with respect to the vertical and the first end of the drum disposed at the bottom of the drum and further comprising:

(b) a filter screen disposed inside and adjacent to the first end of the drum;

(c) a plurality of mixing elements coupled to the drive shaft at spaced apart locations;

(d) a scraper attached to the drive shaft at a position adjacent to the first end of the drum in proximity to the screen for scraping an accumulation of particles from the filter screen; and (e) a vacuum source coupled to said other end of the cylindrical section which has the said closure removed.

11. A multipurpose mixer in acordance with claim 10 further comprising:

(a) a gasket disposed around the periphery of the first end of the drum for forming a seal between the drum and the first end; and (b) a plurality of sections attached to an interior surface of the first end which define channels extending toward the port between the screen and the interior surface through which fluids may be aspirated.

12. A multipurpose mixer in accordance with claim 1 wherein the first end of the drum is held in its closed position by a clamping means.

13. A multipurpose mixer in accordance with claim 1 wherein the closure of the port is held in its closed position by a clamping means.

14. A multipurpose mixer in accordance with claim 1 wherein:

(a) the first end of the drum is held in its closed position by a clamping means; and (b) the closure of the port is held in its closed position by a clamping means.

15. A multipurpose mixer in accordance with claim 1 wherein:

(a) the means for positioning locks the drum into an angular position with the drive shaft inclined with respect to the vertical and the first end of the drum disposed at the bottom of the drum and further comprising;

(b) a filter screen disposed inside of and adjacent to the first end of the drum;

(c) a plurality of mixing elements coupled to the drive shaft at spaced apart locations;

(d) a scraper attached to the drive shaft at a position adjacent to the first end of the drum in proximity to the screen for scraping accumulation of particles from the filter screen; and (e) a vacuum source coupled to the port with closure removed to aspirate the interior of the drum.

16. A multipurpose mixer in accordance with claim 15 further comprising:

(a) a gasket disposed around the periphery of the first end of the drum for forming a seal between the drum and the first end; and (b) a plurality of sections attached to an interior surface of the first end which define channels extending toward the port between the screen and the interior surface through which fluids may be aspirated.

17. A multipurpose mixer in accordance with claim 1 wherein:

(a) the means for positioning locks the drum into an anuglar orientation with the drum drive shaft disposed in a vertical orientation with the second end of the drum disposed at the bottom of the drum; and (b) the drum has a plurality of sections joined together between the first and second ends to define a column with a bottom part and a top part, a first section having a jacket for applying heat to materials within the bottom part of the columns and a plurality of mixing elements attached to the drive shaft within the first section, and at least a second section connected coaxially to the first section and the section disposed at the top part of the column having a jacket for applying cooling to the top part of the column having a jacket for applying cooling to the top part of the column whereby vapor from the bottom of the column is condensed in the top part of the column in proximity to the first end.

18. A multipurpose mixer in accordance with claim 17 wherein the drive shaft in the interior of the column extends from the second end to approximately the intersection of the first and second sections.

19. A multipurpose mixer in accordance with claim 1 wherein:

(a) the means for positioning locks the drum into an angular orientation with the drive shaft disposed in an inclined orientation with the first end of the drum being located on top of the drum;

(b) a plurality of mixing elements are coupled to the drive shaft at spaced apart locations;

(c) a vacuum source is coupled to the port with the closure being opened for aspirating the interior of the drum; and (d) a filter element is disposed within the drum for filtering any particulate material from being aspirated from the drum by the vacuum source.

20. A multipurpose mixer in accordance with claim 19 wherein:

(a) the drum extends past the drive shaft to define a zone in which no mixing elements are located; and (b) the filter element is located within the zone in which no elements are located.

21. A multipurpose mixer in accordance with claim 20 wherein the drum is comprised of two sections which are joined together, the first section containing the plow-shaped mixing elements and the second section defining the zone where no mixing elements are located.

22. A multipurpose mixer in accordance with claim 1 wherein:

(a) the means for positioning locks the drum into an angular orientation with the drive shaft disposed in an inclined orientation with the first end of the drum being disposed on top of the drum;

(b) a plurality of mixing elements are coupled to the drive shaft at spaced apart locations;

(c) a hot air source is coupled to the drum for forcing hot air into the interior of the drum; and (d) a filter element filters air flowing out of the drum through the port with the closure being removed.

23. A multipurpose mixer in accordance with claim 22 wherein:

(a) the drum extends past the drive shaft to define a zone in which no mixing elements are located;

(b) the hot air source is coupled to the zone where no mixing elements are located; and (c) the filter element is external to the drum.

24. A multipurpose mixer in accordance with claim 23 wherein:

(a) the filter element is attached to the first end of the drum and is a bag-type filter element.

25. A multipurpose mixer in accordance with claim 24 wherein the drum is comprised of two sections which are joined together, the first section containing the mixing elements and the second section defining the zone wherein no mixing elements are located.

26. A multipurpose mixer in accordance with claim 1 wherein the motor is a variable speed motor.

27. A multipurpose mixer in accordance with claim 1 wherein the drum has double walls to form a jacket.

* * * * *